US012157994B1

(12) United States Patent
Tapia et al.

(10) Patent No.: US 12,157,994 B1
(45) Date of Patent: Dec. 3, 2024

(54) DISSOLVABLE URINAL SPLASH GUARD

(71) Applicants: Jose Tapia, Pheonix, AZ (US); John Donahue, Chula Vista, CA (US)

(72) Inventors: Jose Tapia, Pheonix, AZ (US); John Donahue, Chula Vista, CA (US)

( * ) Notice: Subject to any disclaimer, the term of this patent is extended or adjusted under 35 U.S.C. 154(b) by 76 days.

(21) Appl. No.: 17/969,938

(22) Filed: Oct. 20, 2022

Related U.S. Application Data

(60) Provisional application No. 63/270,755, filed on Oct. 22, 2021.

(51) Int. Cl.
*E03D 13/00* (2006.01)

(52) U.S. Cl.
CPC ..... *E03D 13/005* (2013.01)

(58) Field of Classification Search
CPC ..... E03D 13/005
USPC ..... 4/300, 300.3, 415, 301, 353, 449
See application file for complete search history.

(56) References Cited

U.S. PATENT DOCUMENTS 4,010,497 A 3/1977 Menter et al.
D332,302 S * 1/1993 Brown ..... E03D 13/005 D23/261
5,365,616 A * 11/1994 Morad ..... E03D 9/032 4/309
5,732,416 A * 3/1998 Albert ..... E03D 9/00 4/300.3
D393,896 S * 4/1998 Wagner ..... E03D 13/005 D23/261
D394,497 S * 5/1998 Johnson ..... E03D 13/005 D23/310
5,813,058 A 9/1998 Quigley et al.
6,170,092 B1 * 1/2001 May ..... A47K 13/24 4/300.3
6,253,395 B1 * 7/2001 Quam ..... E03C 1/181 4/300.3
6,408,447 B1 6/2002 Burbank et al.
6,550,075 B1 * 4/2003 Brannon, III ..... E03D 9/00 4/300.3
7,007,313 B1 * 3/2006 Johnson ..... A47K 13/24 4/300.3

(Continued)

FOREIGN PATENT DOCUMENTS

CH 709390 A2 9/2015
CN 108060711 A * 5/2018 ..... E03D 13/005

(Continued)

*Primary Examiner* — Lori L Baker
(74) *Attorney, Agent, or Firm* — John Rizvi; John Rizvi, P.A.—The Patent Professor

(57) ABSTRACT

A dissolvable urinal splash guard positionable into a bowl of a urinal includes a splash guard assembly including a base having a top and a bottom, wherein the base is at least partially defined by a periphery therearound. A discharge assembly has a discharge aperture formed through a portion of the base. A support assembly including at least one support member is attached to the base and is operative with a drain of the urinal to maintain the dissolvable urinal splash guard in an operative position above the bowl of the urinal during use. At least one of the splash guard assembly, the discharge assembly, or the support assembly is constructed of a material which dissolves in liquid and comprises at least one cleansing agent which is released into a drain pipe of the urinal upon dissolving to help prevent buildup and reduce odors.

19 Claims, 9 Drawing Sheets

(56) References Cited

U.S. PATENT DOCUMENTS

D520,610 S * 5/2006 Wrate ..... E03D 13/005 D4/130
7,178,177 B1 * 2/2007 Valencia ..... E03D 9/00 4/300.3
7,412,732 B1 * 8/2008 Leonard ..... E03D 9/00 4/300.3
7,921,478 B1 * 4/2011 Vanini ..... E03D 9/00 4/300.3
D639,410 S * 6/2011 Ramirez ..... E03D 13/005 D23/310
D660,406 S * 5/2012 Thom ..... A47K 13/005 D23/310
8,434,173 B1 * 5/2013 Drew ..... E03D 9/00 68/225
9,243,394 B2 1/2016 Brown et al.
11,519,164 B1 * 12/2022 Crevier ..... E03D 13/005
11,732,456 B2 * 8/2023 Griffith ..... A47K 13/24 4/300.3
11,737,619 B2 * 8/2023 Braun ..... E03D 9/00 4/300.3
2005/0144711 A1 * 7/2005 Valadez ..... E03D 13/005 4/309
2005/0155304 A1 * 7/2005 Hung ..... E03F 5/0407 52/302.1
2005/0193482 A1 * 9/2005 Gambla ..... E03D 9/00 4/300.3
2006/0037128 A1 * 2/2006 Lewis ..... E03D 13/00 4/300.3
2006/0041998 A1 * 3/2006 Lattanzi ..... E03D 9/00 4/300.3
2006/0096015 A1 * 5/2006 Lim ..... A47K 13/24 4/300.3
2006/0207003 A1 * 9/2006 Harmes ..... A47K 1/14 4/286
2007/0266486 A1 * 11/2007 Ramirez ..... E03D 13/005 4/309
2009/0139017 A1 * 6/2009 Anderson ..... E03D 13/005 4/251.1
2009/0211007 A1 * 8/2009 Partridge ..... A47K 13/24 4/300.3
2009/0320198 A1 12/2009 Yefremov
2010/0024110 A1 * 2/2010 St. John ..... E03D 9/00 4/300.3
2010/0257664 A1 * 10/2010 Kener ..... E03D 13/005 4/300.3
2010/0263115 A1 * 10/2010 Thom ..... E03D 9/00 4/300.3
2012/0255109 A1 * 10/2012 Sciallo ..... E03D 9/00 4/300.3
2013/0000027 A1 * 1/2013 San Luis ..... E03D 9/00 4/300.3
2015/0047114 A1 * 2/2015 Ramirez ..... E03D 9/00 4/300.3
2015/0101115 A1 * 4/2015 Danowski ..... E03D 13/00 4/300.3
2015/0211221 A1 * 7/2015 Tarabay ..... A47K 13/24 4/300.3
2015/0330066 A1 * 11/2015 Marra ..... E03D 9/00 4/300.3
2016/0108609 A1 * 4/2016 Escudero ..... E03D 9/00 4/300.3
2016/0138256 A1 * 5/2016 Abbas ..... E03D 13/005 4/300.3
2017/0007734 A1 * 1/2017 Joshi ..... A61L 9/042
2017/0218612 A1 * 8/2017 Gilles ..... E03D 9/00
2018/0119403 A1 * 5/2018 Crevier ..... E03D 13/005
2018/0163386 A1 * 6/2018 Storey ..... E03D 13/005
2018/0177350 A1 * 6/2018 Escudero ..... E03D 13/005
2018/0238034 A1 * 8/2018 Gwen ..... A47K 11/10
2018/0272022 A1 * 9/2018 Joshi ..... A61L 9/042
2019/0292764 A1 * 9/2019 Crevier ..... E03D 13/005
2019/0307300 A1 10/2019 Smith
2020/0222573 A1 * 7/2020 Joshi ..... B01J 20/28045
2021/0238838 A1 * 8/2021 Crevier ..... E03D 13/005
2023/0220657 A1 * 7/2023 Crevier ..... E03D 13/005 4/300.3

FOREIGN PATENT DOCUMENTS

DE 3703396 A1 8/1988
GB 2329579 A * 3/1999 ..... A47K 11/04
GB 2473273 A * 3/2011 ..... E03D 13/005
WO WO-2014200400 A1 * 12/2014 ..... E03D 13/005

* cited by examiner

DISSOLVABLE URINAL SPLASH GUARD

CROSS-REFERENCE TO RELATED APPLICATIONS

This application claims the benefit of U.S. Patent Application Ser. No. 63/270,755 filed on Oct. 22, 2021, which is incorporated by reference herein in its entirety.

FIELD OF THE INVENTION

The present invention relates generally to a dissolvable urinal splash guard configured to be operatively positioned above a bowl of a urinal, wherein the dissolvable urinal splash guard is at least partially constructed of a material which dissolves in liquid, such as urine, and comprises at least one cleansing agent which is released into a drain pipe of a urinal upon dissolving to help prevent buildup and reduce odors.

BACKGROUND OF THE INVENTION

A urinal provides primarily male users a place to urinate while standing and without removing their trousers, shorts, or other garment, making the process quicker and easier. Urinals require less space to install, and require less to no water in order to operate relative to a toilet. The earliest known version of a urinal dates back to about the $10^{th}$ century, and consisted of little more than a slab with markers to position ones feet, a small bowl carved out of the slab and a drain hole at the bottom of the small bowl.

The modern urinal which is commonplace today has been in existence since the mid 1800's, but has undergone considerable change since then, including more efficient use of water and variations on urinal and urinal bowl design. More recent innovations include waterless systems which incorporates a fluid chemical compound in the drain trap which is less dense than urine such that the urine passes through the compound and into the drain. These compounds are also formulated to minimize the escape of urine odor therethrough, however, they have been found to be less than effective, especially if not properly maintained. Urinals designed specifically for use by women began appearing in the 1990's, though they have yet to become as commonplace as urinals designed for male users.

Despite the various types of urinals, many share several common characteristics. First, there is a back wall which is typically mounted against a supporting surface, such as a wall of a facility, and some form of sidewall on either side of the back wall, ostensibly, to minimize splashing of urine out of the urinal during use, which remains a major problem, as discussed in more detail below. The sidewalls may be pronounced and may extend the full length of the back wall. However, in some cases, presumedly for aesthetic purposes, the sidewalls may contour inwardly from the back wall and may taper from narrow at the top to wider at the bottom. While perhaps more aesthetically appealing, the risk of urine splashing out of such a urinal is significantly greater.

At the bottom of the urinal is a bowl typically having a recessed concave configuration, which serves as the primary receptacle for urine prior to flushing, in a flush-type urinal, during use. A drain is connected typically near the bottom of the bowl and is provided to transfer the urine collected in the urinal for further processing, whether via a sanitary sewer system, a septic tank, or other final disposition. In some cases, the transition from the bowl of the urinal to the drain is simply a single relatively large open hole through the bottom of the bowl, which permits not only urine, but other larger solid objects which a user may dispose of into the urinal, leading to potential for buildup in the drain lines and/or overflows. Alternatively, a drain cover having a plurality of drain holes through it may be mounted to the bottom of the bowl to cover the opening to the drain pipe to prevent large solid objects from entering and clogging the drain pipe. Another common variation includes a plurality of smaller holes through the bottom of the bowl itself, sized to allow urine to flow freely therethrough, while preventing large solid objects from passing through and into the drain of the urinal, so as to reduce the potential for clogging and/or overflow due to solid waste entering the drain.

Regardless of the type of urinal installed in a facility, there are three primary issues which each face while in operation. The first, and most common issue is urine splashing out of the urinal and onto the surrounding floor, walls, or even back onto the person urinating. Attempts to address this problem have focused primarily on the design of the bowl of the urinal, such as extending it further outwardly towards a user, however, this requires additional floor space for installation. Another approach is a wider bowl so as to provide a larger "target" for the person urinating, but again, this can be significantly impacted by available floor space. Raising or lowering the bowl of a urinal to accommodate users of various heights has also been implemented. As will be appreciated, each of these approaches requires a specific design of the urinal bowl and other components as well as specific consideration for minimizing available floor space for urinal installation, particularly in large facilities. As such, this approach can be extremely costly to design and implement.

Another common problem is odor. Even in the case of the waterless urinal wherein the chemical compound in the trap is supposed to prevent urine odor from escaping, the compound is less than 100% effective, especially over time. The most common attempt to resolve the odor problem is in the form of the rather ubiquitous urinal cake, which includes a deodorizing agent typically formulated to attempt to mask the urine odor. However, as anyone who has entered a public restroom knows, the reality is often a rather sickening combination of urine odor and whatever fragrance is incorporated into the urinal cake.

In some instances, a urinal cake is enclosed in an open plastic cage with a plastic mat mounted therearound, wherein the plastic mat is supposed to prevent large solid debris from entering the drain of the urinal, the third common issue affecting the operation of a urinal. As will be appreciated, this combination is considerably more complicated to manufacture, and is therefore necessarily more expensive to use. Furthermore, a considerable amount of plastic waste is generated once the urinal cake dissolves, and this creates a plastic disposal problem of considerable magnitude, especially when the number of urinals utilizing these products are accounted for.

Accordingly, there is an established need for improvements in the sanitary operation of urinals.

SUMMARY OF THE INVENTION

The present invention is generally directed to a dissolvable urinal splash guard.

In a first implementation of the invention, a dissolvable urinal splash guard positionable into a bowl of a urinal in communication with a drain of the urinal may comprise: a splash guard assembly including a base having a top and a bottom, the base at least partially defined by a periphery therearound; a discharge assembly having a discharge aperture formed through a portion of the base; and, a support assembly attached to a portion of the base having at least one support member extending downwardly from the bottom of the base and operative with the drain of the urinal to maintain the dissolvable urinal splash guard in an operative position above the bowl of the urinal during use.

In a second aspect, the dissolvable urinal splash guard can include a discharge assembly comprising a discharge cover mounted over a discharge aperture.

In another aspect, the dissolvable urinal splash guard may have a discharge cover comprising at least one discharge hole formed therethrough.

In a further aspect, the dissolvable urinal splash guard can include a discharge cover comprising a plurality of discharge holes formed therethrough.

In one other aspect, the dissolvable urinal splash guard may have a discharge assembly comprising a cover interface, wherein a discharge cover is interconnected to a base over a discharge aperture proximate the cover interface.

In yet another aspect, the dissolvable urinal splash guard can include at least one support member extending downwardly from a bottom of a base.

In still one further aspect, the dissolvable urinal splash guard may have at least one support member comprising a discharge tube having an upper end and a lower end.

In yet one other aspect, the dissolvable urinal splash guard can include a discharge tube comprising a discharge channel extending therethrough.

In still another aspect, the dissolvable urinal splash guard may have a discharge tube is interconnected to a base proximate a discharge aperture through the base.

In yet one further aspect, the dissolvable urinal splash guard can include a discharge tube having a lower end disposable into a drain pipe of the drain of the urinal, thereby operatively positioning the dissolvable urinal splash guard above the bowl of the urinal.

In still one other aspect, the dissolvable urinal splash guard may have a discharge tube comprising a drain stop disposed at least partially therearound, the drain stop dimensioned to engage a drain stop interface in the drain pipe of the drain of the urinal to facilitate operatively positioning the dissolvable urinal splash guard above the bowl of the urinal.

In yet another aspect, the dissolvable urinal splash guard can include a support assembly comprising a plurality of support members extending downwardly from a bottom of a base.

In still one further aspect, the dissolvable urinal splash guard may have each of a plurality of support members comprising a support leg interconnected to a bottom of a base.

In yet one other aspect, the dissolvable urinal splash guard can include each of a plurality of support legs comprises a drain hole interconnect, each drain hole interconnect disposable through a different one of a plurality of drain holes through a drain cover of a drain of a urinal, thereby operatively positioning the dissolvable urinal splash guard above the bowl of the urinal.

In still another aspect, the dissolvable urinal splash guard may have each of a plurality of drain hole interconnects comprising a tapered configuration to facilitate disposition through a corresponding one of a plurality of drain holes through a drain cover of a drain of a urinal.

In yet one further aspect, the dissolvable urinal splash guard can include at least a splash guard assembly constructed of a material which dissolves in liquid and comprises at least one cleansing agent which is released into a drain pipe of a urinal upon dissolving to help prevent buildup and reduce odors.

In still one other aspect, the dissolvable urinal splash guard may have at least a discharge assembly constructed of a material which dissolves in liquid and comprises at least one cleansing agent which is released into a drain pipe of a urinal upon dissolving to help prevent buildup and reduce odors.

In yet another aspect, the dissolvable urinal splash guard can include at least a support assembly constructed of a material which dissolves in liquid and comprises at least one cleansing agent which is released into a drain pipe of a urinal upon dissolving to help prevent buildup and reduce odors.

In another implementation of the invention, a dissolvable urinal splash guard positionable into a bowl of a urinal in communication with a drain of the urinal can comprise: a splash guard assembly including a base having a top and a bottom, the base at least partially defined by a periphery therearound; a discharge assembly having a discharge aperture formed through a portion of the base and a discharge cover mounted over the discharge aperture, the discharge cover comprising at least one discharge hole formed therethrough; a support assembly having at least one support member extending downwardly from the bottom of the base and operative with the drain of the urinal to maintain the dissolvable urinal splash guard in an operative position above the bowl of the urinal during use; and, at least one of the splash guard assembly, the discharge assembly, or the support assembly is constructed of a material which dissolves in liquid and comprises at least one cleansing agent which is released into a drain pipe of a urinal upon dissolving to help prevent buildup and reduce odors.

In a further implementation of the invention, a dissolvable urinal splash guard positionable into a bowl of a urinal in communication with a drain of the urinal may comprise: a splash guard assembly including a base having a top and a bottom, the base at least partially defined by a periphery therearound; a discharge assembly having a discharge aperture formed through a portion of the base and a discharge cover mounted over the discharge aperture, the discharge cover comprising at least one discharge hole formed therethrough; a support assembly having at least one support member extending downwardly from the bottom of the base and operative with the drain of the urinal to maintain the dissolvable urinal splash guard in an operative position above the bowl of the urinal during use; and, each of the splash guard assembly, the discharge assembly, and the support assembly constructed of a material which dissolves in liquid and comprises at least one cleansing agent which is released into a drain pipe of a urinal upon dissolving to help prevent buildup and reduce odors.

These and other objects, features, and advantages of the present invention will become more readily apparent from the attached drawings and the detailed description of the embodiments, which follow.

BRIEF DESCRIPTION OF THE DRAWINGS

The embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "top", "bottom", "left", "right", "front", "rear", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

As shown throughout the figures, the present invention is directed generally to a dissolvable urinal splash guard, generally as shown as at 100 throughout the figures, configured to be operatively positioned above a bowl of a urinal, wherein the dissolvable urinal splash guard 100 is at least partially constructed of a material which dissolves in liquid, such as urine and/or flush water, and comprises at least one cleansing agent which is released into a drain pipe of a urinal upon dissolving to help prevent buildup and reduce odors.

Figure 1:
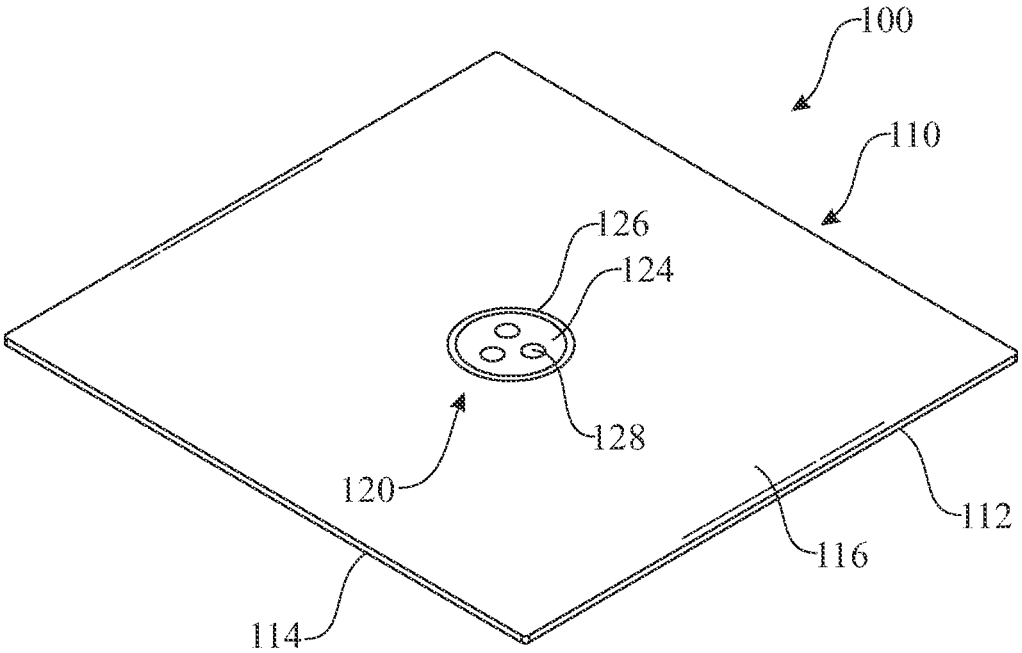
FIG. 1 presents a top perspective view of one illustrative embodiment of a dissolvable urinal splash guard, in accordance with the present invention.
Figure 2:
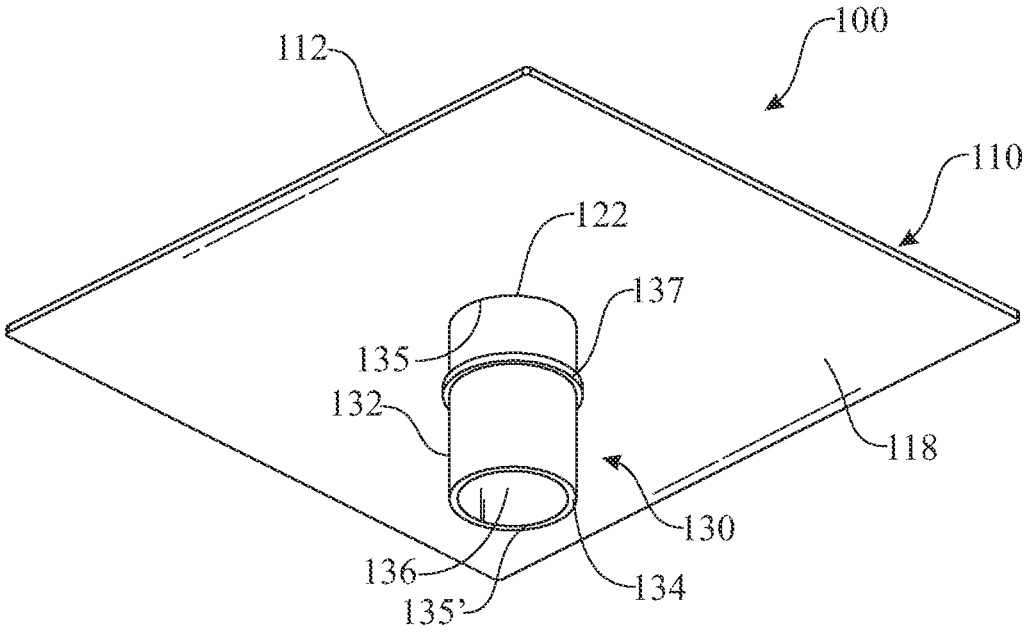
FIG. 2 presents a bottom perspective view of the dissolvable urinal splash guard of FIG. 1, in accordance with the present invention.

Referring initially to FIGS. 1 and 2, presented therein are top and bottom perspective views, respectively, of one illustrative embodiment of a dissolvable urinal splash guard 100 in accordance with the present invention. To begin, a dissolvable urinal splash guard 100 in at least one embodiment includes a splash guard assembly 110 including a base 112. A base 112 of a splash guard assembly 110 is at least partially defined by a periphery 114. In one embodiment, a base 112 has a top 116 which faces upwardly towards a user urinating in the urinal, and a bottom 118 which faces downwardly towards the bowl of the urinal. As shown in the illustrative embodiment of FIGS. 1 and 2, the periphery 114 of the base 112 comprises a generally square configuration. As will be appreciated, and as disclosed further below, a periphery 114 of a base 112 may comprise any of a number of other geographic configurations. In at least one embodiment, a base 112 of a splash guard assembly 110 is at least partially constructed of a material which dissolves in liquid, such as urine, and comprises at least one cleansing agent which is released into a drain pipe of a urinal upon dissolving to help prevent buildup and reduce odors.

In one further embodiment, a base 112 may comprise a slightly contoured or scooped upwardly concave configuration so as to minimize splashing of urine out of the bowl of the urinal and to direct urine flow towards a discharge assembly 120 disposed near the center of the base 112, such as is shown by way of example in the illustrative embodiment of FIGS. 1 and 2. In yet one further embodiment, a base 112 of a splash guard assembly 110 may comprise one or more holes formed therethrough to facilitate a transfer of urine therethrough and into the bowl of the urinal. In addition, the holes formed through a base 112 of a splash guard assembly 110 facilitate dissolution of the material of construction of the base 112.

With continued reference to FIGS. 1 and 2, a dissolvable urinal splash guard 100 further comprises a discharge assembly 120, as disclosed above. A discharge assembly 120 includes a discharge aperture 122 formed through a portion of a base 112 of the splash guard assembly 110. In at least one embodiment, a discharge assembly 120 further comprises a discharge cover 124 which is mounted over a discharge aperture 122. More in particular, a discharge cover 124 is provided to prevent large solid waste from entering a drain of urinal, while allowing urine to pass therethrough. As such, a discharge cover 124 in accordance with at least one embodiment of the present invention includes at least one discharge hole 128 disposed therethrough. In one further embodiment, such as is shown by way of example in FIGS. 1 and 2, a discharge cover 124 comprises a plurality of discharge holes 128 to facilitate the transfer of urine into the drain of the urinal while preventing large solid waste from entering the drain which could result in clogging and/or overflows of the urinal.

In at least one embodiment of a dissolvable urinal splash guard 100 in accordance with the present invention, a discharge assembly 120 further comprises a cover interface 126 disposed around the periphery of a discharge aperture 122 through a base 112 of a splash guard assembly 110, such as is shown in the illustrative embodiment of FIGS. 1 and 2. More in particular, a discharge cover 124 is interconnected to a base 112 over a discharge aperture 122 proximate a cover interface 126. As will be appreciated, a discharge cover 124 may be interconnected to a base 112 via a cover interface 126 by any of a number of fasteners including but not limited to adhesives, press fit, heat welds, staples, rivets, etc., just to name a few. It is to be appreciated that it is within the scope and intent of the present invention for a discharge cover 124 and cover interface 126 to be integrally constructed with one another and/or to be integrally constructed with a base 112. Further, a discharge cover 124 and/or a cover interface 126 in at least one embodiment are at least partially constructed of a material which dissolves in liquid, such as urine and/or flush water, and which, as before, comprises at least one cleansing agent which is released into a drain pipe of a urinal upon dissolving to help prevent buildup and reduce odors.

A dissolvable urinal splash guard 100 in at least one embodiment further comprises a support assembly 130. More in particular, a dissolvable urinal splash guard 100 includes a support assembly 130 comprising at least one support member 132, wherein the support member 132 is dimensioned and configured to maintain the dissolvable urinal splash guard 100 in an operative position at least partially above a bowl of a urinal.

Figure 6:
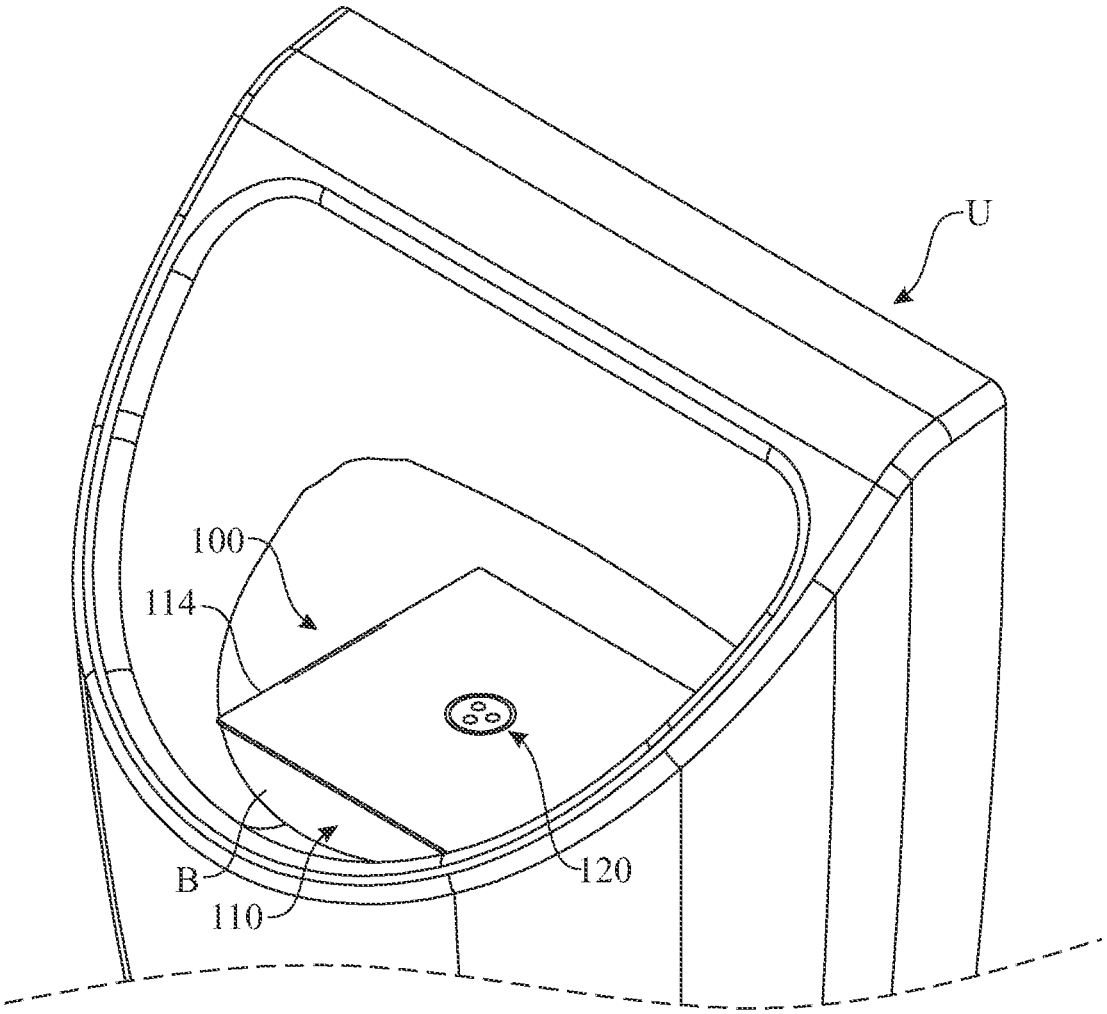
FIG. 6 presents a perspective view of the dissolvable urinal splash guard of FIGS. 1 and 2 operatively positioned above a bowl of a urinal, in accordance with the present invention.

In at least one embodiment, a support assembly 130 includes a support member 132 attached to the base 112 which extends downwardly from the bottom 118 of the base 112. Looking next with reference specifically to FIG. 2, a support assembly 130 in accordance with at least one embodiment of the present invention includes a support member 132 comprising a discharge tube 134 extending downwardly from the bottom 118 of the base 112 of the splash guard assembly 110. A discharge tube 134 includes an upper end 135 which is interconnected to the base 112, and a lower and 135' which is dimensioned and configured to be operatively installed in a drain pipe of a urinal drain, as is discussed in more detail hereinafter. Further, a discharge tube 134 in at least one embodiment includes a discharge channel 136 formed therethrough and extending from the upper end 135 to the lower end 135' to facilitate the transfer of urine therethrough and into the drain of the urinal. FIG. 6 presents a perspective view of the dissolvable urinal splash guard of FIGS. 1 and 2 operatively positioned above a bowl of a urinal, in accordance with the present invention.

Figure 9:
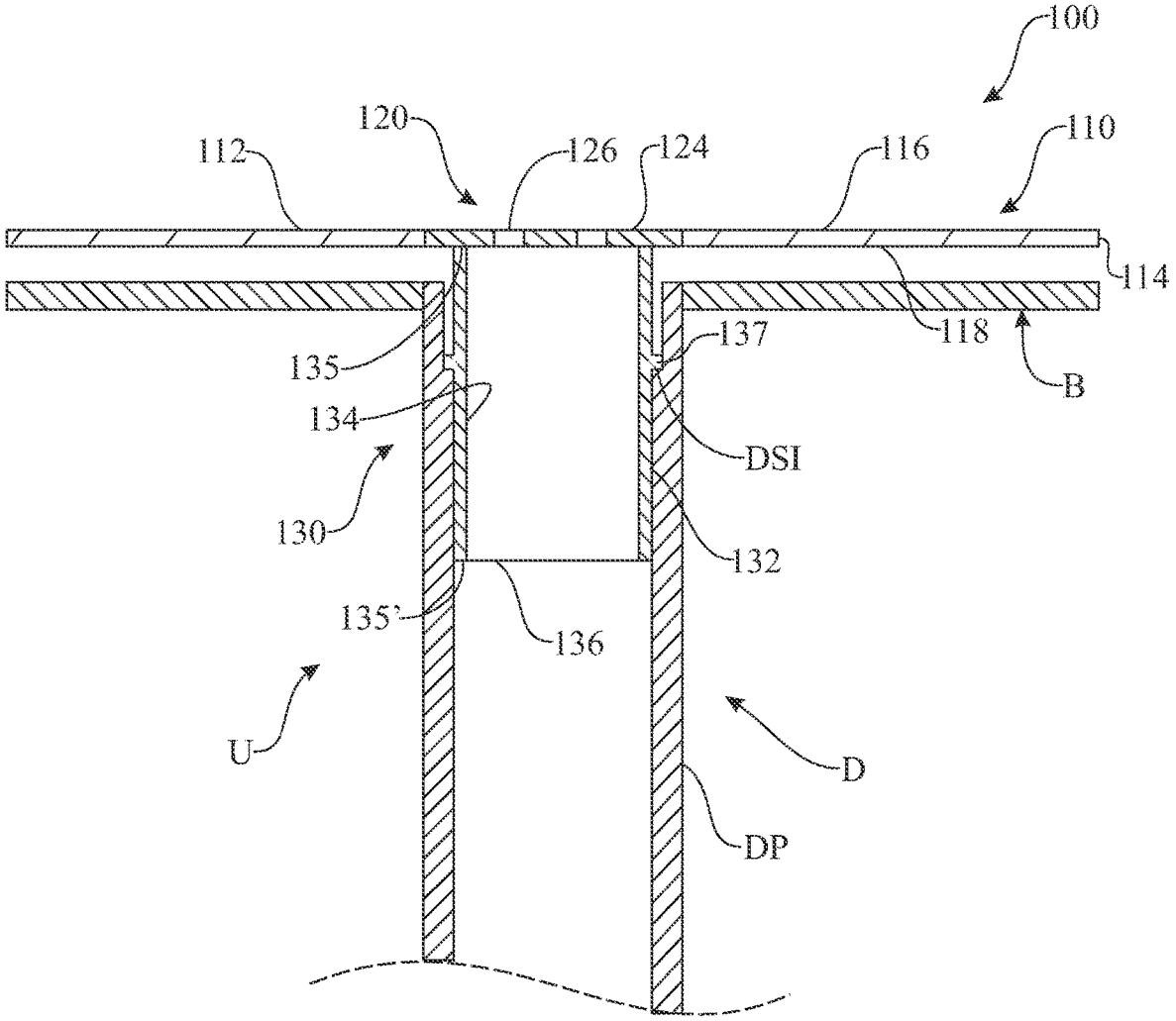
FIG. 9 presents a cross sectional view of the dissolvable urinal splash guard of FIGS. 1 through 4 operatively installed in a drain pipe of a urinal, in accordance with the present invention.

FIG. 9 presents a cross-sectional view of the dissolvable urinal splash guard 100 of FIGS. 1 and 2 operatively installed in a drain pipe (DP) of a drain (D) of a urinal (U), in accordance with the present invention. As may be seen from FIG. 9, the support member 132 of the support assembly 130 comprises a discharge tube 134 having an upper end 135 attached to the bottom 118 of the base 112 of the splash guard assembly 110. As further shown in the illustrative embodiment of FIG. 9, the discharge tube 134 has a lower end 135' dimensioned and configured to be inserted at least partially into the drain pipe (DP) of the drain (D) of the urinal (U). The discharge tube 134 has a discharge channel 136 extending therethrough from the upper end 135 to the lower end 135' to facilitate passage of urine therethrough and into the drain pipe (DP) of the urinal (U). In at least one embodiment, the discharge tube 134 comprises a drain stop 137. A drain stop 137 may be formed partially around the outer diameter of the discharge tube 134, or alternatively, a drain stop 137 may be formed completely therearound. As best seen in the illustrative embodiment of FIG. 9, the drain stop 137 is dimensioned and configured to abut against a drain stop interface (DSI) formed inside of the drain pipe (DP) of the drain (D) of the urinal (U), thereby maintaining the base 112 of the dissolvable urinal splash guard 100 at least slightly above the surface of the bowl (B) of the urinal (U). As such, the base 112 of the splash guard assembly 110 is not disposed in contact with residual urine and/or flush water while not in use, thereof minimizing dissolution of the base 112 while not in use so as to increase the useful life of the present dissolvable urinal splash guard 100.

Similar to a discharge cover 124 of a discharge assembly 120 in accordance with the present invention, a support member 132 of a support assembly 130 may be interconnected to a base 112 by any of a number of fasteners including but not limited to adhesives, press fit, heat welds, staples, rivets, etc., just to name a few. It is once again also to be appreciated that it is within the scope and intent of the present invention for a support member 132 for a support assembly 130 to be integrally constructed with a base 112 of a splash guard assembly 110 in accordance with at least one embodiment of the present invention. As before, a support member 132 of a support assembly 130 in accordance with at least one embodiment of the present invention is at least partially constructed of a material which dissolves in liquid, such as urine and/or flush water, and which, also as before, comprises at least one cleansing agent which is released into a drain pipe of a urinal upon dissolving to help prevent buildup and reduce odors.

Figure 3:
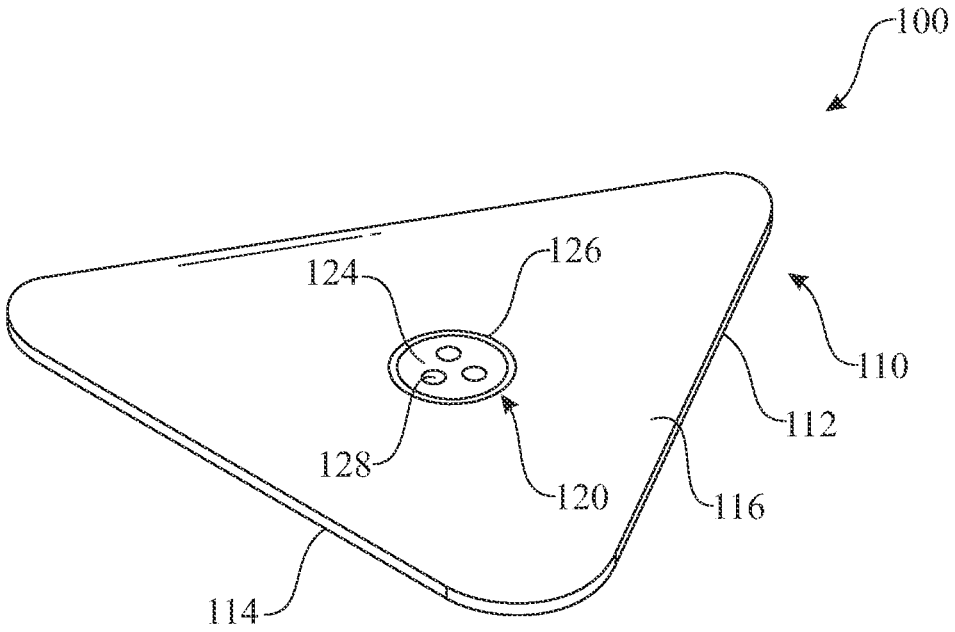
FIG. 3 presents a top perspective view of another illustrative embodiment of a dissolvable urinal splash guard, in accordance with the present invention.
Figure 4:
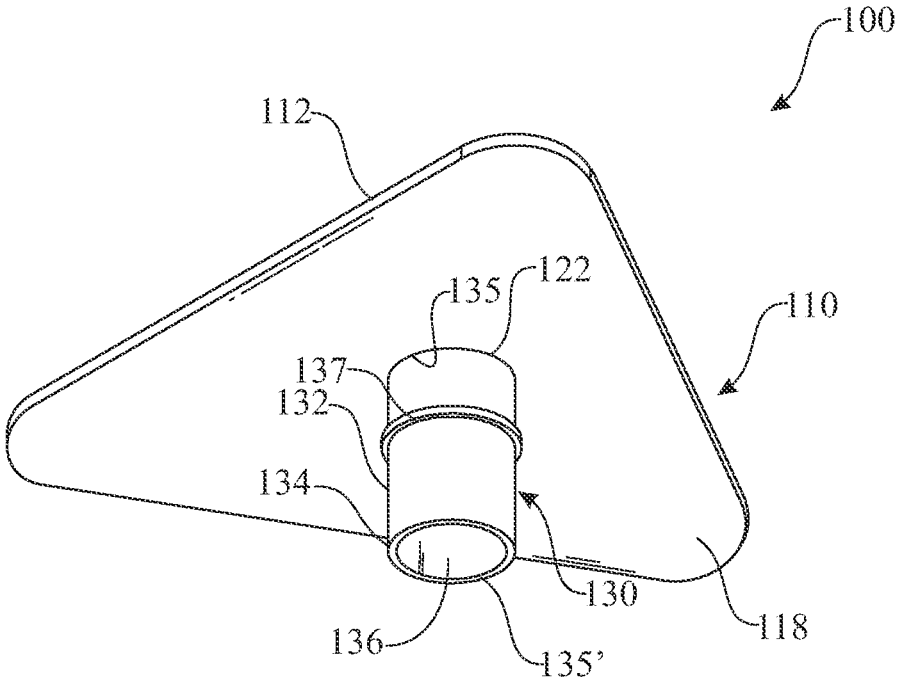
FIG. 4 presents a bottom perspective view of the dissolvable urinal splash guard of FIG. 3, in accordance with the present invention.

Looking next to FIGS. 3 and 4, top and bottom perspective views, respectively, of another illustrative embodiment of a dissolvable urinal splash guard 100 in accordance with the present invention are presented. As before, a dissolvable urinal splash guard 100 in at least one embodiment includes a splash guard assembly 110 including a base 112. Also as before, the base 112 of a splash guard assembly 110 is at least partially defined by a periphery 114. As shown in the illustrative embodiment of FIGS. 3 and 4, the periphery 114 of the base 112 comprises a generally triangular configuration. Once again, a periphery 114 of a base 112 may comprise any of a number of other geographic configurations. In at least one embodiment, the base 112 of a splash guard assembly 110 is at least partially constructed of a material which dissolves in liquid, such as urine and/or flush water, and, once again, and which comprises at least one cleansing agent which is released into a drain pipe of a urinal upon dissolving to help prevent buildup and reduce odors.

As before, the base 112 may comprise a slightly contoured or scooped upwardly concave configuration so as to minimize splashing of urine out of the urinal bowl and to direct urine flow towards a discharge assembly 120 disposed near the center of the base 112, as is shown by way of example in the illustrative embodiment of FIGS. 3 and 4. In yet one further embodiment, and also as before, the base 112 of a splash guard assembly 110 may comprise one or more holes formed therethrough to facilitate a transfer of urine into the bowl of the urinal. In addition, holes formed through a base 112 of a splash guard assembly 110 facilitate dissolving the material of construction of the base 112.

Figure 7:
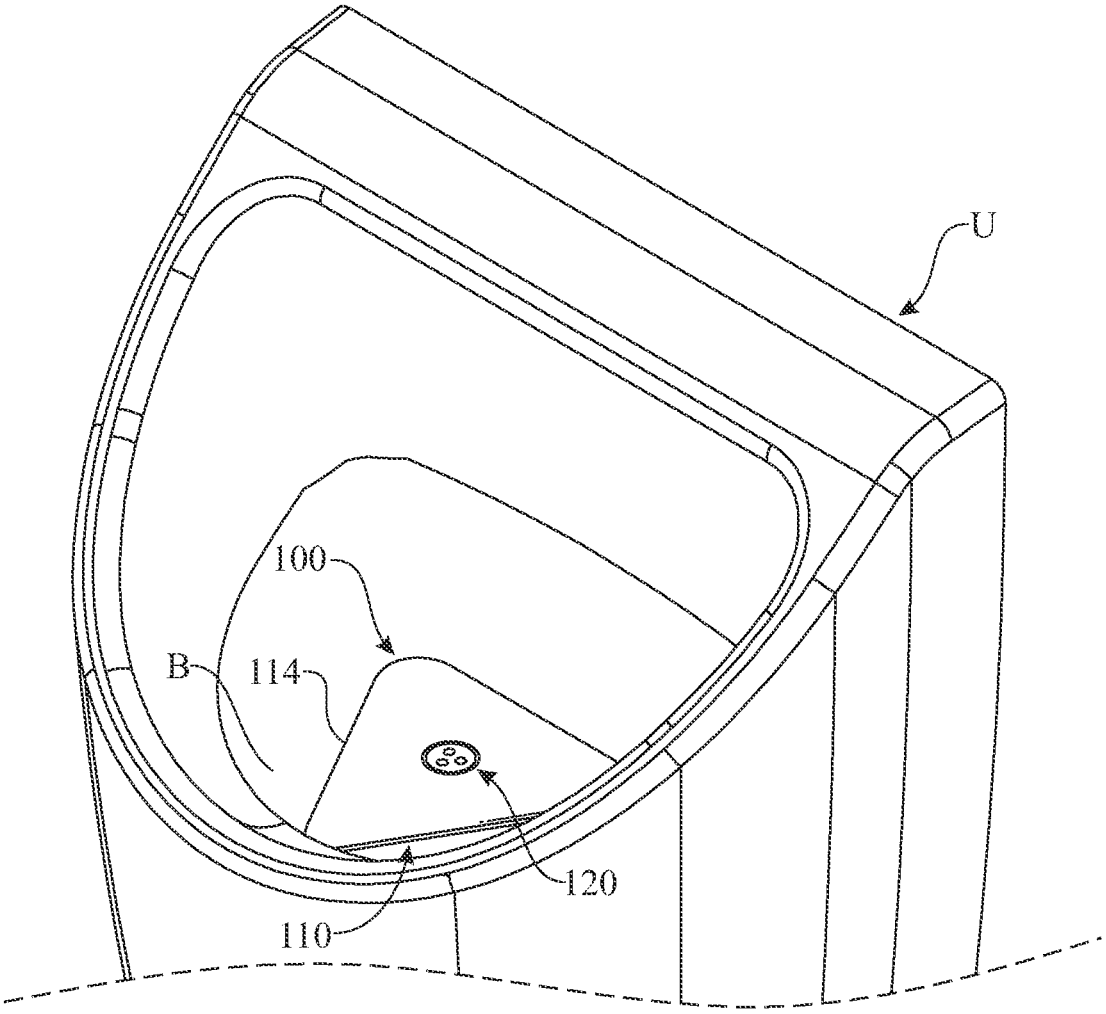
FIG. 7 presents a perspective view of the dissolvable urinal splash guard of FIGS. 3 and 4 operatively positioned above a bowl of a urinal, in accordance with the present invention.

The dissolvable urinal splash guard assembly 100 of the illustrative embodiment of FIGS. 3 and 4 also include a drain assembly 120, such as is disclosed and described above with reference to FIGS. 1 and 2. Similar to the embodiment of FIGS. 1 and 2, the dissolvable urinal splash guard 100 of the illustrative embodiment of FIGS. 3 and 4 also include a support assembly 130, as disclosed and described above. More in particular, the support assembly 130 includes a support member 132 dimensioned and configured to maintain the dissolvable urinal splash guard 100 in an operative position above a bowl of a urinal. As before, the support member 132 comprises a discharge tube 134 having a discharge channel 136 formed therethrough to facilitate the transfer of urine into the drain of the urinal. FIG. 7 presents a perspective view of the dissolvable urinal splash guard of FIGS. 3 and 4 operatively positioned above a bowl of a urinal, in accordance with the present invention.

As with the illustrative embodiment of the dissolvable urinal splash guard 100 of FIGS. 1 and 2, each of the splash guard assembly 110, the discharge assembly 120 and/or the support assembly 130 of the dissolvable urinal splash guard 100 of FIGS. 3 and 4 are at least partially constructed of a material which dissolves in liquid, such as urine and/or flush water, and which, also as before, comprises at least one cleansing agent which is released into a drain pipe of a urinal upon dissolving to help prevent buildup and reduce odors.

Figure 5:
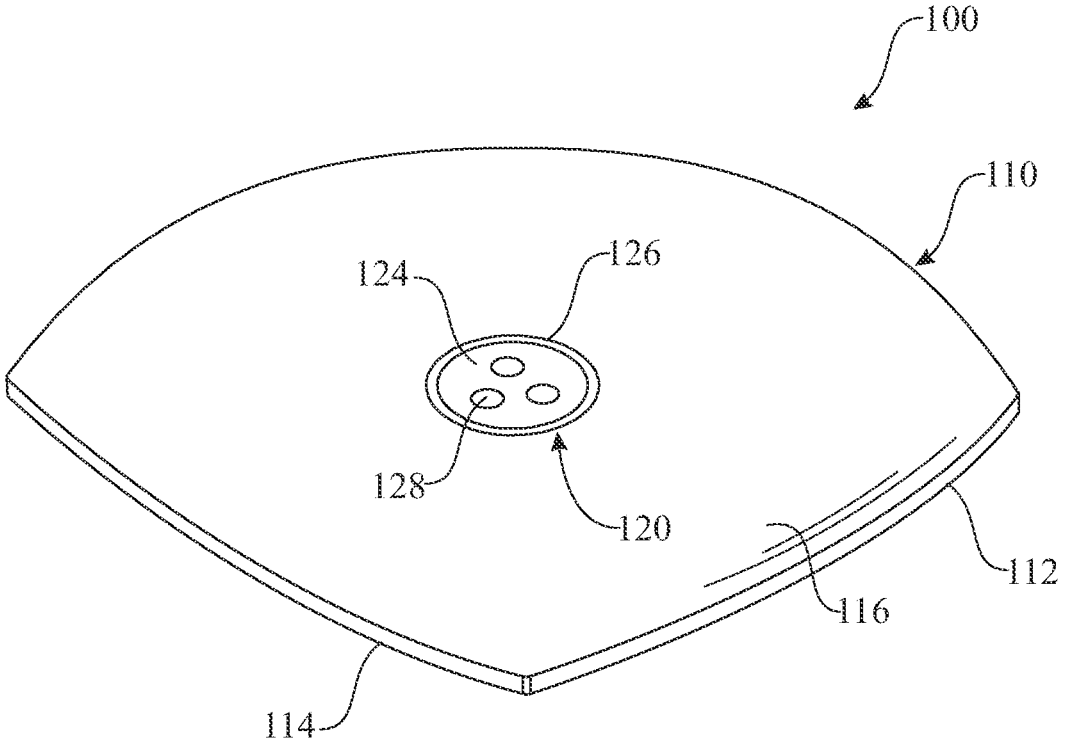
FIG. 5 presents a top perspective view of one further illustrative embodiment of a dissolvable urinal splash guard, in accordance with the present invention.
Figure 8:
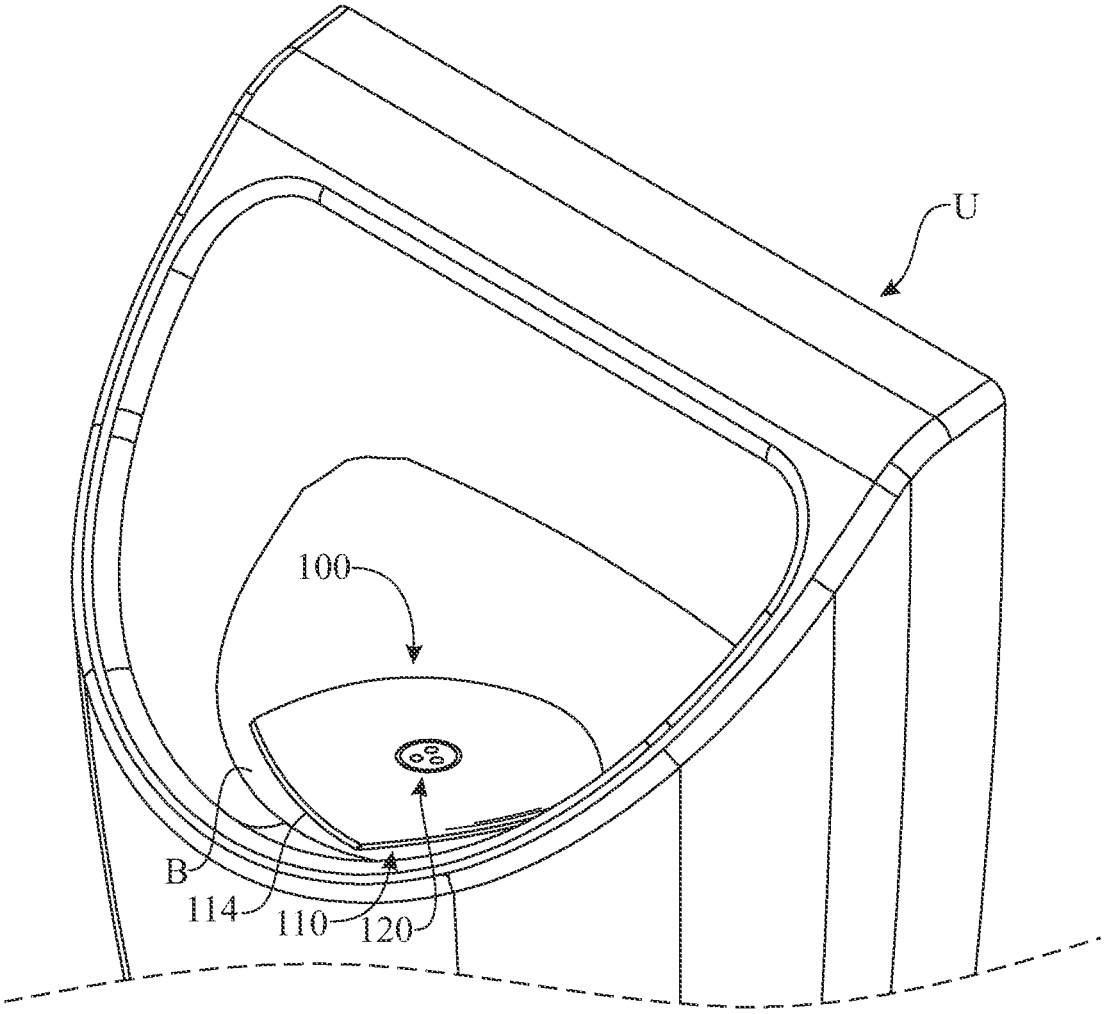
FIG. 8 presents a perspective view of the dissolvable urinal splash guard of FIG. 5 operatively positioned above a bowl of a urinal, in accordance with the present invention.

Looking next to FIG. 5, a top perspective view of yet another embodiment of a dissolvable urinal splash guard 100 in accordance with the present invention is shown. As before, the dissolvable urinal splash guard 100 includes a splash guard assembly 110 having a base 112 at least partially defined by a periphery 114. As shown in the illustrative embodiment of FIG. 5, the periphery 114 of the base 112 comprises a generally arcuate configuration. As before, the base 112 may comprise a slightly contoured or scooped upwardly concave configuration so as to minimize splashing of urine out of the bowl of the urinal and to direct urine flow towards a discharge assembly 120 disposed near the center of the base 112, as is shown by way of example in the illustrative embodiment of FIG. 5. In yet one further embodiment, and also as before, the base 112 of a splash guard assembly 110 may comprise one or more holes formed therethrough to facilitate a transfer of urine into the bowl of the urinal and to facilitate dissolution of the base 112. FIG. 8 presents a perspective view of the dissolvable urinal splash guard of FIG. 5 operatively positioned above a bowl of a urinal, in accordance with the present invention.

Figure 10:
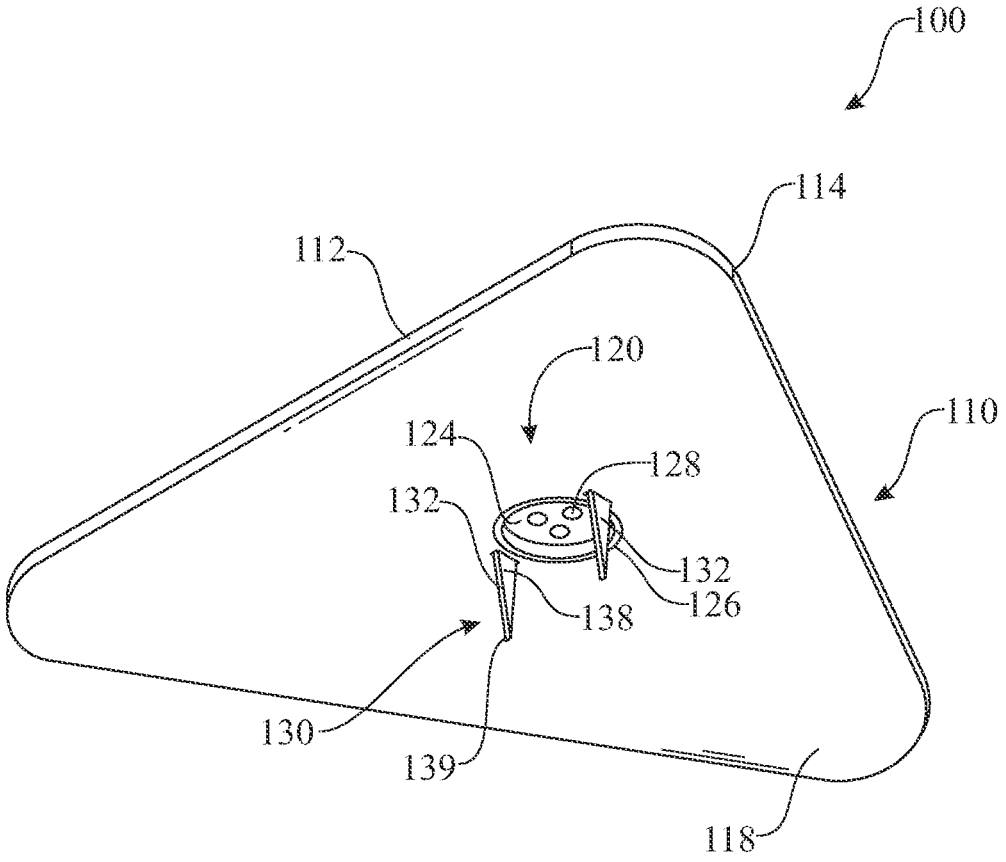
FIG. 10 presents a bottom perspective view of one alternative illustrative embodiment of a dissolvable urinal splash guard, in accordance with the present invention.

Alternative embodiments are contemplated in addition the embodiments(s) shown and/or described herein. By way of example, FIG. 10 presents a bottom perspective view of one alternative illustrative embodiment of a dissolvable urinal splash guard 100, in accordance with the present invention. As with the previously disclosed embodiments, the dissolvable urinal splash guard 100 includes a splash guard assembly 110 including a base 112, wherein the base 112 is at least partially defined by a periphery 114. In one embodiment, a base 112 includes a top (not shown) which faces upwardly towards a user urinating in the urinal, and a bottom 118 which faces downwardly towards the bowl of the urinal. As shown in the illustrative embodiment of FIG. 10, the periphery 114 of the base 112 comprises a generally triangular configuration. As before, the periphery 114 of the base 112 may comprise any of a number of other geographic configurations. Also as before, in at least one embodiment, the base 112 of the splash guard assembly 110 is at least partially constructed of a material which dissolves in liquid, such as urine, and comprises at least one cleansing agent which is released into a drain pipe of a urinal upon dissolving to help prevent buildup and reduce odors.

The dissolvable urinal splash guard 100 of the illustrative embodiment of FIG. 10 also comprises a discharge assembly 120, as disclosed above. The discharge assembly 120 includes a discharge aperture 122 formed through a portion of a base 112 of the splash guard assembly 110, and a discharge cover 124 mounted over the discharge aperture 122. As before, the discharge cover 124 is provided to prevent large solid waste from entering a drain of urinal, while allowing urine to pass therethrough, and as such, the discharge cover 124 in accordance with at least one embodiment of the present invention includes one or more discharge holes 128 disposed therethrough.

The dissolvable urinal splash guard 100 of the illustrative embodiment of FIG. 10 also comprises a support assembly 130 including a plurality of support members 132 dimensioned and configured to maintain the dissolvable urinal splash guard 100 in an operative position above a bowl of a urinal. More in particular, each of the plurality of support members 132 include a support leg 138 attached at one end to the bottom 118 of the base 112 of the splash guard assembly 110. Each of the plurality of support legs 138 further comprises a drain hole interconnect 139 disposed on the opposite end thereof. As shown best in FIG. 10, in at least one embodiment each of the plurality of drain hole interconnects 139 comprise a tapered configuration so as to further facilitate maintaining the base 112 of the dissolvable urinal splash guard 100 in an operative position above a bowl of a urinal, as shown best in FIG. 11 described below.

Figure 11:
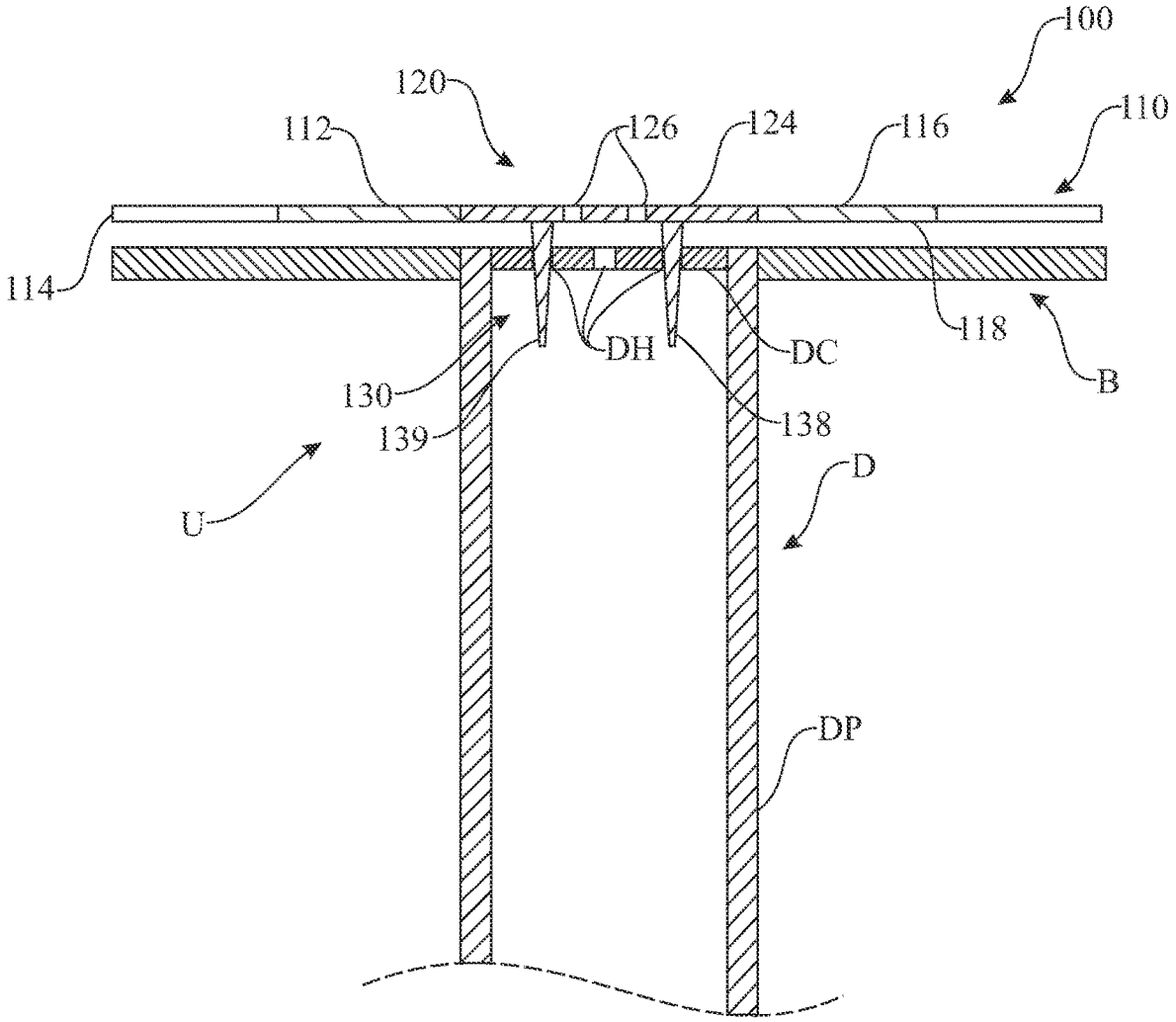
FIG. 11 presents a cross sectional view of the dissolvable urinal splash guard of FIG. 1 operatively installed through a drain cover of a drain pipe of a urinal, in accordance with the present invention.

More in particular, and with reference to FIG. 11, presented therein is a cross-sectional view of the dissolvable urinal splash guard 100 of FIG. 10 operatively installed through the drain cover (DC) of the drain (D) above the bowl (B) of the urinal (U), in accordance with the present invention. As shown best in FIG. 11, each of the plurality of support legs 138 is disposed into and at least partially through a different corresponding one of the plurality of drain holes (DH) through the drain cover (DC) of the drain (D) of the urinal (U). More importantly, and as also shown best in FIG. 11, the plurality of support legs 138 serve to maintain the base 112 of the dissolvable urinal splash guard 100 at least slightly above the surface of the bowl (B) of the urinal (U). As such, and as before, the base 112 of the splash guard assembly 110 is not disposed in contact with residual urine and/or flush water while not in use, thereof minimizing dissolution of the base 112 while not in use so as to increase the useful life of the present dissolvable urinal splash guard 100.

A material of construction of at least one of a splash guard assembly 110, a discharge assembly 120 or a support assembly 130 in one embodiment of the present invention dissolves in liquid, such as, once again, urine and/or flush water, and comprises at least one cleansing agent which is released into a drain pipe of a urinal upon dissolution to help prevent buildup and reduce odors. More in particular, the material of construction in one embodiment includes a cleansing agent comprising a mixture of sodium sulfate, wheat flower, carboxymethyl cellulose, sodium lauroamphoacetate, calcium carbonate, sodium chloride, polyquaternium-7, lipase, sodium benzoate, water and amylase. In at least one embodiment, a cleansing agent comprises a mixture of about 51% sodium sulfate, about 6% wheat flower, about 7% carboxymethyl cellulose, about 2% sodium lauroamphoacetate, about 17% calcium carbonate, about 6% sodium chloride, about 3% polyquaternium-7, about 1% lipase, about 0.2% sodium benzoate, about 0.5% water and about 0.2% amylase.

In still one further embodiment, the material of construction of one or more of the components of the present dissolvable urinal splash guard assembly 100, namely, a support assembly 110, a discharge assembly 120 and a support assembly 130, includes an amount of a fragrance to aid in reducing odors while the present invention is in use.

Since many modifications, variations, and changes in detail can be made to the described embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A dissolvable urinal splash guard positionable into a bowl of a urinal in communication with a drain of the urinal, said dissolvable urinal splash guard comprising:

a splash guard assembly including a base having a top and a bottom, said base at least partially defined by a periphery therearound;

a discharge assembly having a discharge aperture formed through a portion of said base; and a support assembly attached to a portion of said base having at least one support member operative with the drain of the urinal to maintain said dissolvable urinal splash guard in an operative position above the bowl of the urinal during use, wherein said at least one support member extends downwardly from said bottom of said base.

2. The dissolvable urinal splash guard as recited in claim 1, wherein said discharge assembly comprises a discharge cover mounted over said discharge aperture.

3. The dissolvable urinal splash guard as recited in claim 2, wherein said discharge cover comprises at least one discharge hole formed therethrough.

4. The dissolvable urinal splash guard as recited in claim 2, wherein said discharge cover comprises a plurality of discharge holes formed therethrough.

5. The dissolvable urinal splash guard as recited in claim 2, wherein said discharge assembly comprising a cover interface, said discharge cover interconnected to said base over said discharge aperture proximate said cover interface.

6. The dissolvable urinal splash guard as recited in claim 1, wherein said at least one support member comprises a discharge tube having an upper end and a lower end.

7. The dissolvable urinal splash guard as recited in claim 6, wherein said discharge tube comprises a discharge channel extending therethrough.

8. The dissolvable urinal splash guard as recited in claim 6, wherein said discharge tube is interconnected to said base proximate said discharge aperture through said base.

9. The dissolvable urinal splash guard as recited in claim 6, wherein said lower end of said discharge tube is disposable into a drain pipe of the drain of the urinal, thereby operatively positioning said dissolvable urinal splash guard above the bowl of the urinal.

10. The dissolvable urinal splash guard as recited in claim 6, wherein said discharge tube comprises a drain stop disposed at least partially therearound, said drain stop dimensioned to engage a drain stop interface in a drain pipe of the drain of the urinal to facilitate operatively positioning said dissolvable urinal splash guard above the bowl of the urinal.

11. The dissolvable urinal splash guard as recited in claim 1 wherein said support assembly comprises a plurality of support members extending downwardly from said bottom of said base.

12. The dissolvable urinal splash guard as recited in claim 11, wherein each of said plurality of support members comprises a support leg interconnected to said bottom of said base.

13. The dissolvable urinal splash guard as recited in claim 12, wherein each said support leg comprises a drain hole interconnect, each said drain hole interconnect disposable through a different one of a plurality of drain holes through a drain cover of the drain of the urinal, thereby operatively positioning said dissolvable urinal splash guard above the bowl of the urinal.

14. The dissolvable urinal splash guard as recited in claim 13, wherein each said drain hole interconnect comprises a tapered configuration to facilitate disposition through a corresponding one of the plurality of drain holes through the drain cover of the drain of the urinal.

15. The dissolvable urinal splash guard as recited in claim 1, wherein at least said splash guard assembly is constructed of a material which dissolves in liquid and comprises at least one cleansing agent which is released into a drain pipe of a urinal upon dissolving to help prevent buildup and reduce odors.

16. The dissolvable urinal splash guard as recited in claim 1, wherein at least said discharge assembly is constructed a material which dissolves in liquid and comprises at least one cleansing agent which is released into a drain pipe of a urinal upon dissolving to help prevent buildup and reduce odors.

17. The dissolvable urinal splash guard as recited in claim 1, wherein at least said support assembly is constructed of a material which dissolves in liquid and comprises at least one cleansing agent which is released into a drain pipe of a urinal upon dissolving to help prevent buildup and reduce odors.

18. A dissolvable urinal splash guard positionable into a bowl of a urinal in communication with a drain of the urinal, said dissolvable urinal splash guard comprising:

a splash guard assembly including a base having a top and a bottom, said base at least partially defined by a periphery therearound;

a discharge assembly having a discharge aperture formed through a portion of said base and a discharge cover mounted over said discharge aperture, said discharge cover comprising at least one discharge hole formed therethrough;

a support assembly having at least one support member extending downwardly from said bottom of said base and operative with the drain of the urinal to maintain said dissolvable urinal splash guard in an operative position above the bowl of the urinal during use; and at least one of said splash guard assembly, said discharge assembly, or said support assembly is constructed of a material which dissolves in liquid and comprises at least one cleansing agent which is released into a drain pipe of the urinal upon dissolving to help prevent buildup and reduce odors.

19. A dissolvable urinal splash guard positionable into a bowl of a urinal in communication with a drain of the urinal, said dissolvable urinal splash guard comprising:

a splash guard assembly including a base having a top and a bottom, said base at least partially defined by a periphery therearound;

a discharge assembly having a discharge aperture formed through a portion of said base and a discharge cover mounted over said discharge aperture, said discharge cover comprising at least one discharge hole formed therethrough;

a support assembly having at least one support member extending downwardly from said bottom of said base and operative with the drain of the urinal to maintain said dissolvable urinal splash guard in an operative position above the bowl of the urinal during use; and each of said splash guard assembly, said discharge assembly, and said support assembly constructed of a material which dissolves in liquid and comprises at least one cleansing agent which is released into a drain pipe of the urinal upon dissolving to help prevent buildup and reduce odors.

* * * * *